US005836035A

United States Patent [19]

McElfish et al.

[11] Patent Number: 5,836,035

[45] Date of Patent: Nov. 17, 1998

[54] ADJUSTABLE SHOWER BACK CLEANER

[76] Inventors: Donald C. McElfish, 4718 Gerald, Warren, Mich. 48092; Anthony S. Schwartz, 1203 Ski Park Dr., West Branch, Mich. 48661

[21] Appl. No.: 784,458

[22] Filed: Jan. 16, 1997

[51] Int. Cl.[6] ..... A46B 15/00

[52] U.S. Cl. ..... 15/160; 15/244.1; 4/606; 248/222.52

[58] Field of Search ..... 4/606; 15/104.92, 15/160, 210.1, 244.1; 248/222.52, 223.41, 225.11; 601/136

[56] References Cited

U.S. PATENT DOCUMENTS

| | | | |
|---|---|---|---|
| 2,901,760 | 9/1959 | Nelson . | |
| 3,078,484 | 2/1963 | Briggs | 4/606 |
| 3,085,269 | 4/1963 | Greer | 4/606 |
| 3,109,177 | 11/1963 | McKinley Grafmyer . | |
| 3,196,867 | 7/1965 | Perry . | |
| 3,289,215 | 12/1966 | Kennedy . | |
| 3,478,369 | 11/1969 | Ensley . | |
| 4,008,503 | 2/1977 | Tharp . | |
| 4,699,127 | 10/1987 | Schley . | |
| 4,712,265 | 12/1987 | Williams . | |
| 4,943,018 | 7/1990 | Glaser et al. . | |
| 5,239,712 | 8/1993 | Kinder . | |
| 5,277,389 | 1/1994 | Ballares et al. . | |

*Primary Examiner*—Terrence Till
*Attorney, Agent, or Firm*—Peter D. Keefe

[57] ABSTRACT

A shower back cleaner easily repositionable to optimally interface with the backs of each respective user of the shower, is composed generally, of a mounting rail, a mounting member for connecting the mounting rail to a shower wall, a base, a cleaning member (preferably in the form of a brush or sponge) which is connected with the base, and a cam means for connecting the base to the mounting rail wherein the base is slidable along the mounting rail and is affixable at any selected location along the mounting rail by a simple turn of the base in relation to the mounting rail The cam means is composed of a flanged slot formed in the mounting rail and a cam connected with the base. The cam is trappingly situated in the flanged slot. Rotation of the cam provides a selective amount of abutting force of the cam with respect to sidewalls of the flanged slot, ranging from zero force wherein the base is freely slidable in relation to the mounting rail to a level of force wherein the base is frictionally frozen with respect to the mounting rail.

19 Claims, 2 Drawing Sheets

ADJUSTABLE SHOWER BACK CLEANER

BACKGROUND OF THE INVENTION

1. Field of the Invention

The present invention relates to devices for cleaning the back of a showering person, particularly but not necessarily, a physically disabled person. More particularly, the present invention relates to an easily mounted, easily adjusted and easily used shower back cleaner.

2. Description of the Prior Art

Showering is routine for physically able persons, but can be something of a challenge for physically disabled persons. Even so, whether a person is or is not physically able, cleaning of the back is quite difficult, in that one's hands cannot reach the middle back area.

It is possible to reach the middle back area using some sort of hand-held handled brush or sponge, wherein the handle enables the brush or sponge to reach the middle back. However, for persons having a physical disability, the manipulations necessary to achieve this result may be difficult or impossible to realize. Also, persons who are physically able, may find the necessity to use a hand-held handled brush or sponge to be annoying or otherwise undesirable. As a result, it would be beneficial if a brush or sponge could be used by a showering person which would reach the middle back, yet not require the necessity of being hand-held.

Devices for cleaning the back of a showering person are known in the art whereby a brush or sponge is mounted to a shower wall. Some devices, such as represented by U.S. Pat. No. 4,008,503 to Tharp, dated Feb. 22, 1977 are rotatably powered and are generally mechanically complex, and may include options, such as a soaper. Other devices are less mechanically involved, such as a slidably adjustable brush described in U.S. Pat. No. 2,901,760 to Nelson, dated Sep. 1, 1959.

While a spectrum of shower back cleaners are known, there yet remains needed in the art a shower back cleaner which is structured for being easily and selectively mounted with respect to a shower wall, is easily repositionable to optimally interface with the backs of each respective user of the shower, and is easily used to clean the back during a shower even by physically disadvantaged persons.

SUMMARY OF THE INVENTION

The present invention is a shower back cleaner which is structured for being easily and selectively mounted with respect to a shower wall, is easily repositionable to optimally interface with the backs of each respective user of the shower, and is easily used to clean the back during a shower even by physically disadvantaged persons.

The back cleaner according to the present invention is composed, generally, of a mounting rail, a mounting member for connecting the mounting rail to a shower wall, a base, a cleaning member (preferably in the form of a brush or sponge) which is connected with the base, and a cam means for connecting the base to the mounting rail wherein the base is slidable along the mounting rail and is affixable at any selected location along the mounting rail by a simple turn of the base in relation to the mounting rail.

The cam means is composed of a flanged slot formed in the mounting rail and a cam connected with the base. The cam is trappingly situated in the flanged slot. Rotation of the cam provides a selective amount of abutting force of the cam with respect to sidewalls of the flanged slot, ranging from zero force wherein the base is freely slidable in relation to the mounting rail to a level of force wherein the base is frictionally frozen with respect to the mounting rail.

In operation, a user attaches the mounting rail to a shower wall via the mounting member which is preferably in the form of a plurality of double sided adhesive foam strips. Each shower user then adjusts the height of the base so that the cleaning member will suitably interface with their respective back by turning the base to release or freeze it slidably in relation to the mounting rail via the selective camming action of the cam.

Accordingly, it is an object of the present invention to provide a shower wall mountable back cleaner which is easily height adjustable.

It is a further object of the present invention to provide a shower wall mountable back cleaner which is easily height adjustable by simple movements which can be performed by persons having limited hand dexterity.

These, and additional objects, advantages, features and benefits of the present invention will become apparent from the following specification.

DETAILED DESCRIPTION OF THE PREFERRED EMBODIMENT

Figure 1:
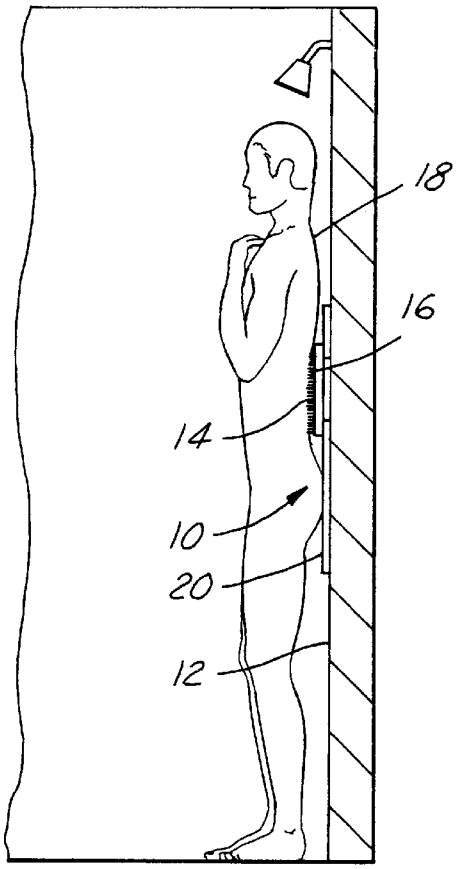
FIG. 1 is a partly sectional side view, showing the shower back cleaner according to the present invention in a typical environment of operation.
Figure 2:
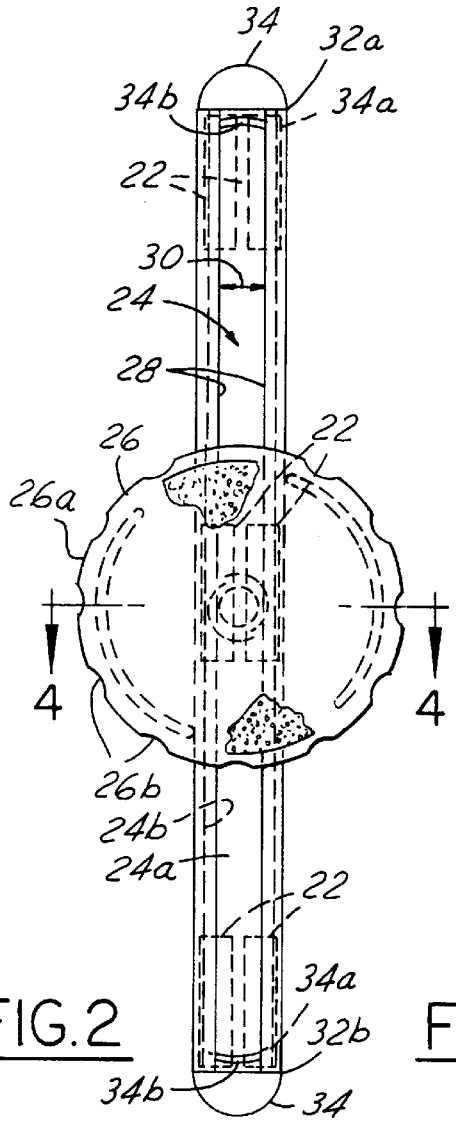
FIG. 2 to a front plan view of the shower back cleaner according to the present invention.
Figure 3:
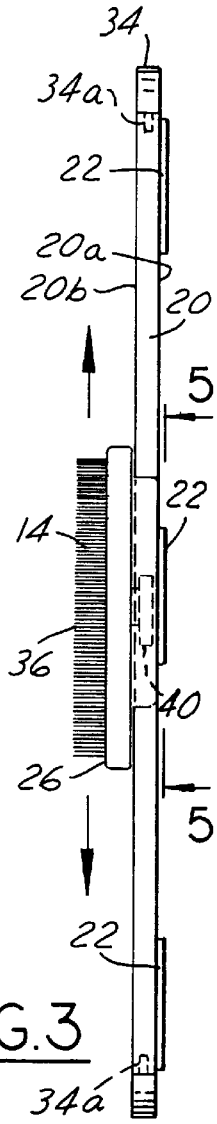
FIG. 3 is a side view of the shower back cleaner according to the present invention.

Referring to the Drawing, FIGS. 1 through 3 generally depict a shower back cleaner 10 according to the present invention. The shower back cleaner 10 is, as shown in FIG. 1, attached to a shower wall 12. The shower back cleaner generally includes a cleaning member 14, and is adjustable so that the cleaning member is selectively locatable at an optimum location to cleaningly interface with the middle back 16 of a showering person 18. In operation, the person moves his or her back in relation to the cleaning member 14 so as to cause the cleaning member to clean the middle back 16. The preferred structural material of the base 26 and the mounting rail 20 is plastic, preferably formed by a conventional plastic molding operation.

As shown best by FIGS. 2 and 3, the shower back cleaner 10 includes an elongated mounting rail 20 having a rear side 20*a* and an opposite front side 20*b*. The rear side 20*a* of the mounting rail 20 is attachable to a shower wall 12 via a mounting member 22. The front side 20*b* is provided with a flanged slot 24 running along its length for interconnecting with a base 26 which carries the cleaning member 14.

The preferred form of mounting member 22 is a plurality of strips of double-sided adhesive foam 22*a* (see FIG. 4), wherein a user removes a protective covering to expose an adhesive at the outwardly facing side of the foam which is then pressed to the shower wall 12 (which is clean and dry at the time of application) to thereby affix the mounting rail 20 thereto. The mounting member 22 may be otherwise constituted, such as for example screws, suction cups or glue.

The flanged slot 24 includes a bottom wall 24*a*, opposing sidewalls 24*b* and opposing flanges 28 which overhang the sidewalls in perpendicular relation thereto and in parallel relation to the bottom wall. The flanges 28 are mutually spaced apart to provide an entry gap 30.

The ends 32*a*, 32*b* of the mounting rail 20 are provided with end caps 34 which define the terminal ends of the flanged slot. Each end cap 34 has a projection portion 34*a* which is slidably received into the flanged slot 24, wherein the flanges 28, sidewalls 24*b* and bottom wall 24*a* provide a tight fit with respect thereto. Each end cap 34 is preferred to have an inclined surface 34*b* at the flanged slot 24 for facilitating drainage of shower water therefrom.

The base 26 has, preferably, a round periphery 26*a*; however, other geometrically shaped peripheries are possible. It is preferred for the periphery 26*a* to be coarsely knurled by indentations 26*b* for facilitating a person to grab and rotate the base 26 by hand.

Figure 4:
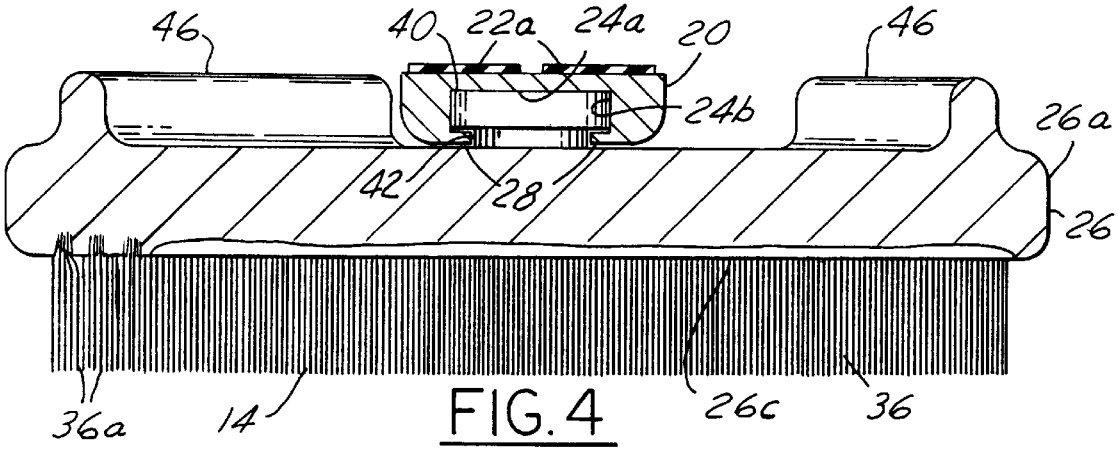
FIG. 4 is a partly sectional view of the shower back cleaner, seen along line 4—4 in FIG. 2.
Figure 7:
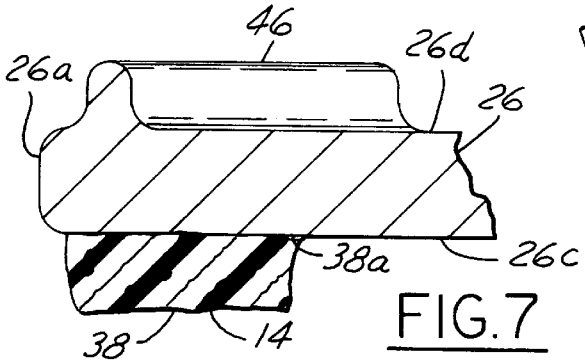
FIG. 7 is a partly broken away, partly sectional side view of the base of the shower cleaner according to the present invention, wherein now a cleaning member in the form of a sponge, rather than a brush, is depicted.

A front face 26*c* of the base 26 is generally flat and connected with the cleaning member 14. In FIGS. 1 through 4 and 7, the depicted cleaning member 14 is in the form of a brush 36, which is most preferred. In FIG. 7, the depicted cleaning member 14 is in the form of a sponge 38. As shown in FIG. 4 the bristles 36*a* of the brush 36 are anchored in a conventional manner into the front face 26*c* of the base 26. As shown in FIG. 7, the sponge 38 is attached to the front face 26*c* of the base 26 by a non-toxic, water stable adhesive 38*a*.

A rear face 26*d* of the base 26 is provided with a cam 40 which perpendicularly projects therefrom at the geometrical center thereof via a stem 42. The stem 42 extends about the height of the flanges 28 (in relation to the bottom wall 24*a*) and has a diameter a little less than the gap 30 (see FIG. 4). The cam 40 is dimensioned to be received into the flanged slot 24, wherein the flanges 28 overhang the cam. Accordingly, the flanges interferingly prevent the cam 40 from being dislodged from the mounting rail 20. In order to place the cam 40 into the flanged slot 24, one or the other of the end caps 34 is slidingly removed from the mounting rail 20 so that the cam can be slid into the flanged slot. Thereafter, the removed end cap 34 is slid back into place on the mounting rail 20, thereby trapping the cam 40 in the flanged slot 24.

Figure 5:
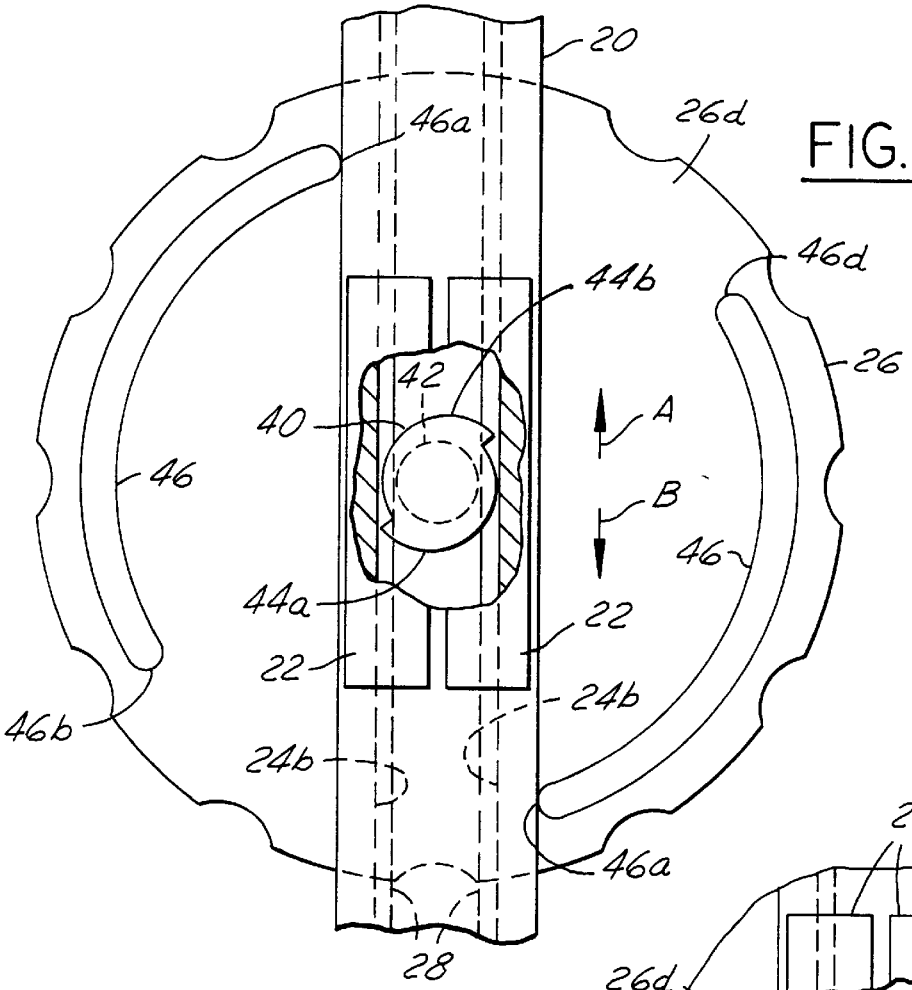
FIG. 5 is a partly broken away, partly sectional rear view of the shower back cleaner, seen along line 5—5 in FIG. 3, wherein the base is rotatably positioned to permit free slidability thereof with respect to the mounting rail.
Figure 6:
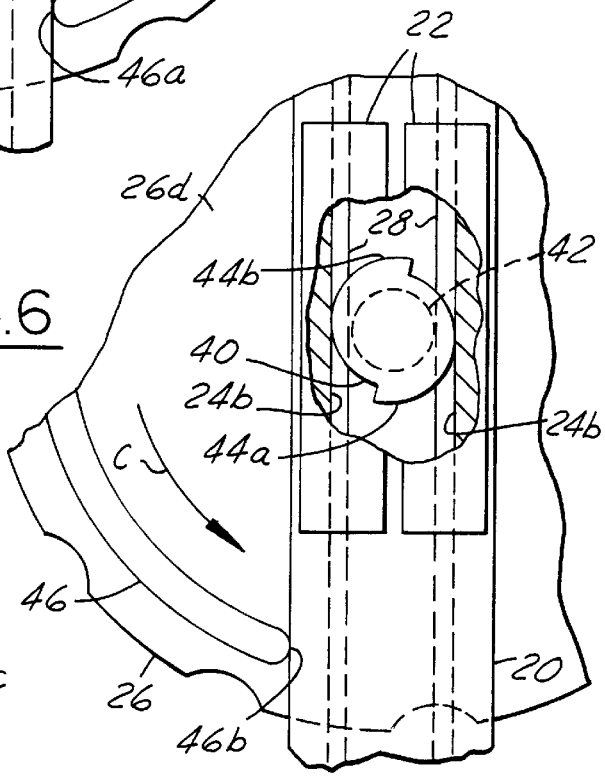
FIG. 6 is a partly broken away, partly sectional rear view of the shower back cleaner as generally seen in FIG. 5, wherein now the base rotated in relation to the mounting rail such that the base is slidably frozen.

As shown best by FIGS. 5 and 6, the cam has two spiraling cam surf aces 44*a*, 44*b* which are mutually diametrically opposed. Since the cam 40 and its stem 42 are fixedly connected with the base 26, rotation of the base results in simultaneous rotation of the cam. The combination of the flanged slot 24 and the cam 40 provide a cam means which connects the base 26 to the mounting rail 20 and provides for adjusting the position of the base along the mounting rail.

As shown at FIG. 5, the cam 40 can be rotated to an adjustment position wherein the cam surfaces 44*a*, 44*b* provide a diameter, as measured directly between opposed sidewalls 24*b* of the flanged slot 24, which is less than the distance between the opposed sidewalls. In this position, since the cam 40 has play with regard to the flanged slot 24, the base 26 is freely slidable along the mounting rail 20 (see arrows A and B).

As shown at FIG. 6, the cam 40 is rotated (see arrow C) in the direction of increasing spiral of the cam surfaces 44*a*, 44*b* to an affixment position wherein the cam surfaces provide a diameter, as measured directly between opposing sidewalls 24*b* of the flanged slot 24, which is just more than the distance between the opposed sidewalls. In this position, since the cam is tightly jammed against the sidewalls 24*b*, the base 26 is slidably frozen in relation to the mounting rail 20.

Ribs 46 are located on the rear face 26*d* of the base 26 which project from the rear surface sufficiently to serve as outboard stabilizers in abuttable relation to the shower wall 12; that is, the ribs 46 project a distance slightly less than the rear side 20*a* of the mounting rail 20 (see FIG. 4). The ribs 46 ensure that an untoward amount of mechanical strain is not applied to the cam 40 and its stem 42 during a back cleaning episode, since the ribs will abut the shower wall 12 when the peripheral areas of the base are pressed toward the shower wall. Preferably, the ends 46*a*, 46*b* of the ribs 46 abut the mounting rail at, respectively, each of the adjustment and affixment positions of the cam 40 (see FIGS. 5 and 6).

In operation, the user affixes the rear side of the mounting rail to a selected location on a shower wall, wherein the length of the mounting rail provides locations for the cleaning member to be locatable at the middle back of known or likely users of the shower. Each user (where necessary for optimum performance of the shower back cleaner) rotates the base to free the cam in relation to the flanged slot, whereby free movement of the base along the mounting rail is made possible. The base is then slid to a location on the mounting rail where the cleaning member is situated centrally with respect to the middle back of the user. The user then rotates the base oppositely to thereby cammingly jam the cam in the flanged slot, whereby the base is slidingly frozen in relation to the mounting rail. Now the user takes a shower and cleans his or her middle back by moving his or her back abuttably about the cleaning member. The next shower user makes a similar adjustment of the location of the base, if necessary.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A shower back cleaner for being connected with a shower wall comprising:

an elongated mounting rail, said mounting rail having a rear side and an opposite front side;

mounting member means for attaching said rear side of said mounting rail to a shower wall;

a base having a front face and an opposite rear face;

cleaning member means connected with said front face of said base for abuttably cleaning a showering person; and cam means responsive to rotation of said base in relation to said mounting rail for slidingly connecting said rear face of said base to said mounting rail, wherein rotation of said base to an adjustment position results in said cam means permitting free sliding movement of said base in relation to said mounting rail, and wherein rotation of said base to an affixment position results in said cam means affixing said base in slidingly frozen relation to said mounting rail.

2. The shower back cleaner of claim 1, wherein said cam means comprises:

a flanged slot located on said front side of said mounting rail; and a cam affixed to said rear face of said base such that rotation of said base simultaneously rotates said cam, wherein said cam is trappingly situated in said flanged slot in a selectively slidable relationship with respect to said flanged slot, wherein said selective slidability of said cam is dependent upon rotational position of said cam with respect to said flanged slot.

3. The shower back cleaner of claim 2, wherein said cam comprises two diametrically opposed spiraling surfaces, said cam being connected to said rear face of said base by a stem; further wherein said flanged slot comprises:

a pair of opposing sidewalls;

a bottom wall connected with said pair of sidewalls; and a pair of flanges, one flange being respectively connected with each sidewall of said pair of sidewalls in overhanging relation thereto, said pair of flanges being mutually separated by a gap;

wherein said stem is received through said gap and said cam is interferingly trapped in said flanged slot by said pair of flanges; further wherein said spiraling surfaces are freely slidable in relation to said sidewalls when said base is at said adjustment position, and said spiraling surfaces are abuttingly jammed against said sidewalls when said base is at said affixment position.

4. The shower back cleaner of claim 3, wherein said rail member has a first end and an opposite second end, said rail member further comprising an end cap respectively located at each of said first and second ends, at least one said end cap being selectively removable from said mounting rail for installing and removing said cam with respect to said flanged slot.

5. The shower back cleaner of claim 4, further comprising rib means located at said rear face of said base for providing support of said base with respect to a shower wall in spaced relation to said cam.

6. The shower back cleaner of claim 5, wherein said cam means selectively abuts said mounting rail such as to thereby define said adjustment and affixment positions of said base.

7. The shower back cleaner of claim 4, wherein each said end cap has an inclined surface adjoining said flanged slot for facilitating water removal from said flanged slot during a shower.

8. The shower back cleaner of claim 4, wherein said cleaning member means is a brush.

9. The shower back cleaner of claim 4, wherein said cleaning member means is a sponge.

10. The shower back cleaner of claim 4, wherein said mounting member means comprises a plurality of double-sided adhesive foam strips.

11. A shower back cleaner for being connected with a shower wall comprising:

an elongated mounting rail, said mounting rail having a rear side and an opposite front side;

mounting member means for attaching said rear side of said mounting rail to a shower wall, said front side having formed therein a flanged slot;

a base having a front face and an opposite rear face;

cleaning member means connected with said front face of said base for abuttably cleaning a showering person; and a cam affixed to said rear face of said base such that rotation of said base simultaneously rotates said cam, wherein said cam is trappingly situated in said flanged slot in a selectively slidable relationship with respect to said flanged slot, wherein rotation of said base to an adjustment position results in said cam permitting free sliding movement of said base in relation to said mounting rail, and wherein rotation of said base to an affixment position results in said cam affixing said base in slidingly frozen relation to said mounting rail.

12. The shower back cleaner of claim 11, wherein said cam comprises two diametrically opposed spiraling surfaces, said cam being connected to said rear face of said base by a stem; further wherein said flanged slot comprises:

a pair of opposing sidewalls;

a bottom wall connected with said pair of sidewalls; and a pair of flanges, one flange being respectively connected with each sidewall of said pair of sidewalls in overhanging relation thereto, said pair of flanges being mutually separated by a gap;

wherein said stem is received through said gap and said cam is interferingly trapped in said flanged slot by said pair of flanges; further wherein said spiraling surfaces are freely slidable in relation to said sidewalls when said base is at said adjustment position, and said spiraling surfaces are abuttingly jammed against said sidewalls when said base is at said affixment position.

13. The shower back cleaner of claim 12, wherein said rail member has a first end and an opposite second end, said rail member further comprising an end cap respectively located at each of said first and second ends, at least one said end cap being selectively removable from said mounting rail for installing and removing said cam with respect to said flanged slot.

14. The shower back cleaner of claim 13, further comprising rib means located at said rear face of said base for providing support of said base with respect to a shower wall in spaced relation to said cam.

15. The shower back cleaner of claim 14, wherein said cam means selectively abuts said mounting rail such as to thereby define said adjustment and affixment positions of said base.

16. The shower back cleaner of claim 15, wherein each said end cap has an inclined surface adjoining said flanged slot for facilitating water removal from said flanged slot during a shower.

17. The shower back cleaner of claim 16, wherein said mounting member means comprises a plurality of double-sided adhesive foam strips.

18. The shower back cleaner of claim 17, wherein said cleaning member means is a brush.

19. The shower back cleaner of claim 17, wherein said cleaning member means is a sponge.

* * * * *